US011848118B2

(12) United States Patent
Johanson

(10) Patent No.: US 11,848,118 B2
(45) Date of Patent: Dec. 19, 2023

(54) CONDUCTOR

(71) Applicant: NEXANS, Courbevoie (FR)

(72) Inventor: Audun Johanson, Oslo (NO)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 17/589,936

(22) Filed: Feb. 1, 2022

(65) Prior Publication Data

US 2022/0246322 A1 Aug. 4, 2022

(30) Foreign Application Priority Data

Feb. 3, 2021 (EP) ..... 21305144

(51) Int. Cl.
*H01B 1/02* (2006.01)
*H01B 7/14* (2006.01)
*H01B 9/00* (2006.01)

(52) U.S. Cl.
CPC ..... *H01B 1/023* (2013.01); *H01B 7/14* (2013.01); *H01B 9/00* (2013.01)

(58) Field of Classification Search
USPC ..... 174/126.1
See application file for complete search history.

(56) References Cited

U.S. PATENT DOCUMENTS 3,711,339 A * 1/1973 Besel ..... H01B 1/02 148/416
4,010,046 A 3/1977 Setzer et al.
4,183,771 A 1/1980 Hardy et al.
2008/0274375 A1* 11/2008 Ng ..... C25D 11/024 205/330
2015/0159069 A1* 6/2015 Ranganathan ..... H01B 3/441 252/75

OTHER PUBLICATIONS

European Search Report dated Jul. 23, 2021.
"Aluminum cable conductor eases water depth restrictions on power umbilicals", Offshore Magazine, Apr. 1, 2012.
Alcatel Submarine Networks (ASN): "First aluminium conductor for subsea optical cable", Optical connections, Jan. 23, 2019.
Herve Fevrier, Grubb Stephen, Harrington Nicholas, Palmer-Felgate Andy, Rivera-Hartling Elizabeth, Stuch Tim: "Facebook Perspective on Submarine Wet Plant Evolution", Optical Fiber Communication Conference (OFC) 2019, vol. 060, Mar. 6, 2019.
M. Socariceanu, X. An, A. Deighton, A.Friday: "Corrosion Assessment of Aluminium Conductor for Medium Voltage Cables for Subsea Umbilical System", ASME 2018 37th International Conference on Ocean, Offshore and Arctic Engineering, vol. 5. Jun. 17, 2018.

* cited by examiner

*Primary Examiner* — Krystal Robinson
(74) *Attorney, Agent, or Firm* — Sofer & Haroun, LLP

(57) ABSTRACT

An aluminium based conductor made of an alloy has at least 98 wt % aluminium, from 0.25 to 0.45 wt % iron, from 0.07 to 0.25 wt % copper and from 0.001 to 0.10 wt % boron, having high strength and conductivity. The present arrangement also includes a method for obtaining such conductors.

13 Claims, 2 Drawing Sheets

CONDUCTOR

RELATED APPLICATION

Figure 1A:
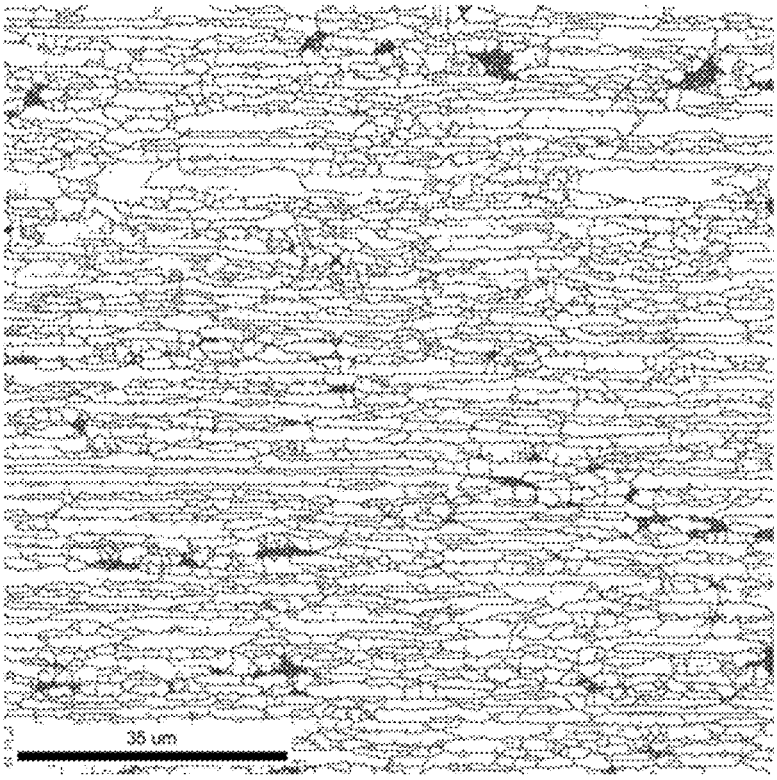

This application claims the benefit of priority from European Patent Application No. 21 305 144.4, filed on Feb. 3, 2021, the entirety of which is incorporated by reference.

TECHNICAL FIELD

The present invention relates to conductors with a high strength and conductivity and to a method for obtaining such conductors.

BACKGROUND

High strength electrical conductors are a crucial element for subsea power cables. The challenge in improving such conductors is to increase either the strength or the conductivity without compromising the other or without drastically increasing the production costs.

U.S. Pat. No. 4,183,771 describes a process for making an aluminium alloy conductor wire for use in building wire or telephone and telecommunications wire applications. The aluminium alloy wire has a diameter between 0.002 and 0.500 inch and contains from 0.04 to 1.0 wt % iron, from 0.02 to 0.2 wt % silicon, from 0.1 to 1.0 wt % copper, from 0.001 to 0.2 wt % boron, balance essentially aluminium.

U.S. Pat. No. 4,010,046 describes a method of extruding aluminium base alloys having high strength and high electrical conductivity properties. The aluminium base alloy containing from 0.04 to 1.0% iron, from 0.02 to 0.2% silicon, from 0.1 to 1.0% copper, from 0.001 to 0.2% boron, balance essentially aluminium U.S. Pat. No. 3,711,339 describes an improved aluminium alloy conductor. The conductor is characterized by a combination of good mechanical and electrical properties and contains from 0.04 to 1.0% iron, 0.02 to 0.2% silicon, 0.1 to 1.0% copper, 0.001 to 0.2% boron, balance essentially aluminium.

U.S. Pat. No. 4,213,779 describes an aluminium base conductor wire having an electrical conductivity equivalent to commercial grade aluminium conductor wire consisting essentially of 0.04 to 1.0 wt % iron, 0.02 to 0.2 wt % silicon, 0.1 to 1.0 wt % copper, 0.001 to 0.2 wt % boron, 0.001 to 1.0 wt % mischmetal, balance essentially aluminium and a process of forming such conductor wire.

Several aluminium based conductors with high strength and conductivity and method for preparing them are known, but all have various disadvantages that should be overcome.

The goal of the present invention is to provide conductors with high strength, without compromising their electrical conductivity, at a reduced cost. In particular, the present invention provides improved Al-conductors. Such conductors allow to reduce cost of subsea power cables by introducing a high strength conductor without compromising its electrical conductivity, while the production process stays simple.

SUMMARY OF THE INVENTION

The present invention is defined by the appended claims and in the following:

In a first aspect, the present invention provides an aluminium based conductor made of an alloy comprising from 0.25 to 0.45 wt % iron, from 0.07 to 0.25 wt % copper and from 0.001 to 0.10 wt % boron. An aluminium based conductor is a conductor comprising an alloy having at least 98 wt %, at least 99 wt %, at least 99.2 wt %, or at least 99.4 wt % aluminium.

Percentage by weight, weight percent or wt % is calculated based on the total weight of the alloy.

In an embodiment of the conductor according to the invention, the alloy may comprise from 0.30 to 0.35 wt % iron. In another embodiment of the conductor according to the invention, the alloy may comprise 0.31-0.32 wt % iron.

In another embodiment of the conductor according to the invention, the alloy may comprise from 0.15 to 0.20 wt % copper. In another embodiment of the conductor according to the invention, the alloy may comprise 0.16-0.18 wt % copper.

In another embodiment of the conductor according to the invention, the alloy may comprise 0.001 to 0.04 wt % boron In another embodiment of the conductor according to the invention, the alloy may comprise up to 0.50 wt % total of other elements, selected from a group consisting of Mn, Cr, Ni, Bi, Ga, V, Ti, Zn, Si, P, Sn, S, Be, Co, Zr, Pb, Na, Sr, Li, Cd and Mg, each element being present in an amount of less than 0.20 wt %.

In another embodiment of the conductor according to the invention, the alloy may comprise up to 0.30 wt % total of other elements, selected from a group consisting of Mn, Cr, Ni, Bi, Ga, V, Ti, Zn, Si, P, Sn, S, Be, Co, Zr, Pb, Na, Sr, Li, Cd and Mg, each element being present in an amount of less than 0.10 wt %.

In another embodiment of the conductor according to the invention, the alloy may comprise up to 0.10 wt % total of other elements, selected from a group consisting of Mn, Cr, Ni, Bi, Ga, V, Ti, Zn, Si, P, Sn, S, Be, Co, Zr, Pb, Na, Sr, Li, Cd and Mg, each element being present in an amount of less than 0.05 wt %.

In another embodiment of the conductor according to the invention, the conductor may have an average grain size in the longitudinal (drawing) direction (length) superior to 3 μm and an average grain size in the transversal direction (width) inferior to 2 μm; both measured from electron backscatter diffraction (EBSD) scans using the line-intercept method with 80 lines in each direction (averages are arithmetic averages).

In another embodiment of the conductor according to the invention, the conductor may have grains with an average elongation ratio (average length of the grain/average width of the grain) of more than 1.2, of more than 1.5, of more than 2 or an elongation ratio between 1.2 and 10.

In another embodiment of the conductor according to the invention, the conductor may be obtained by a process comprising the steps of:

- providing the alloy in a liquid (molten) form;
- rod casting the alloy yielding a rod;
- drawing the rod to a conductor having a desired final geometry, and possibly
- stranding one or more rods to a final conductor design.

In the drawing step the rod is reduced to a shaped profile with a cross section reduction relative to the original rod of between 50% and 90% or of between 60% and 85%.

In another embodiment of the conductor according to the invention, the conductor may be obtained by a process comprising the steps of:

- providing a rod made of the alloy;
- drawing the rod to a conductor having a desired final geometry, and possibly
- stranding one or more rods to a final conductor design.

In another embodiment of the conductor according to the invention, the conductor may have an ultimate tensile strength of at least 180 MPa, at least 190 MPa or least 200 MPa; measured according to ISO 6892-1.

In another embodiment of the conductor according to the invention, the conductor may have a conductivity of more than 59% IACS; measured according to IEC 60468.

In another embodiment of the conductor according to the invention, the conductor may have an elongation at break>1.8%, >2.0% or >2.2%; measured according to ISO 6892-1.

In another embodiment of the conductor according to the invention, the conductor may have an elongation at break between 1.8% and 50%, between 2.0% and 20%, between 2.2% and 10%, or between 2.2% and 5%; measured according to ISO 6892-1.

In a second aspect, the present invention provides a subsea cable comprising a conductor according to the first aspect of the invention.

In an embodiment of the subsea cable according to the invention, the subsea cable may be an armorless subsea cable.

The term "armorless" is used here to refer to cables not comprising any additional axial load carrying elements except for the conductor(s).

In a third aspect, the present invention provides a method for producing a conductor including the steps of:

providing an alloy comprising 0.25 to 0.45 wt % iron, from 0.07 to 0.25 wt % copper and from 0.001 to 0.10 wt % boron, and at least 98 wt % aluminium in a molten form;

rod casting said composition yielding a rod;

drawing the rod to a conductor having a desired final geometry; and possibly stranding one or more rods to a final conductor design.

The term "conductor" may alternatively be replaced by other similar terms such as conductor wire, electrical wire, etc.

SHORT DESCRIPTION OF THE DRAWINGS

The present invention is described in detail by reference to the following drawings:

FIG. 1*a* is an Electron backscatter diffraction (EBSD) scan of an embodiment of the invention.

Figure 1B:
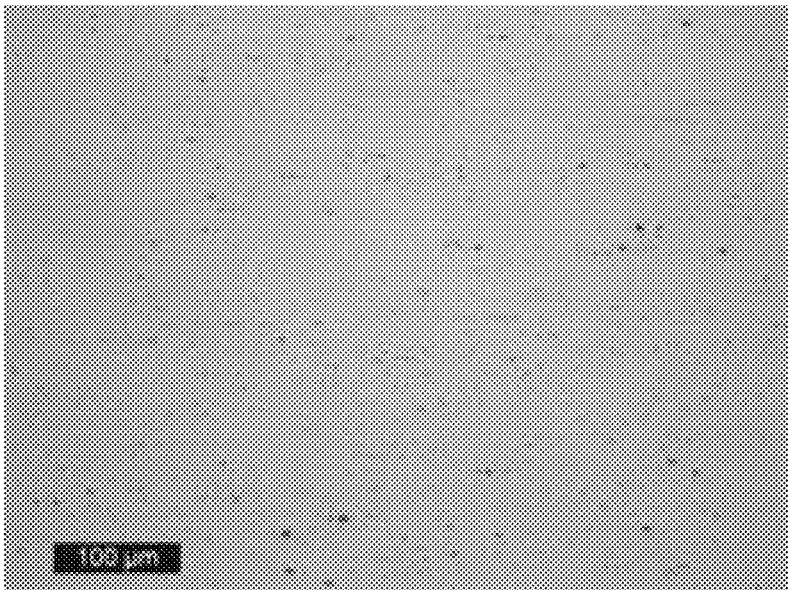

FIG. 1*b* is a light optical image of a microstructure of an exemplary conductor according to the invention.

Figure 2:
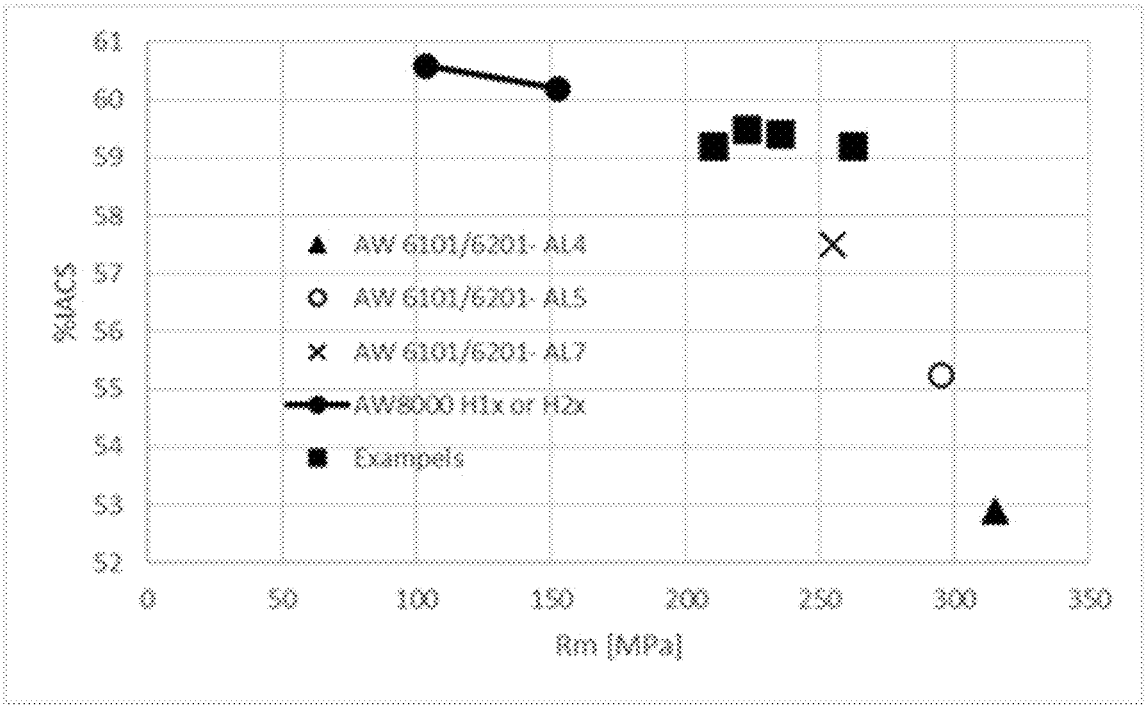

FIG. 2 is a graph representing the conductivity of different conductors as a function of their ultimate tensile strength.

DETAILED DESCRIPTION OF THE INVENTION

The present invention provides an improved conductor useful in building and communication wire applications, especially in subsea power cable applications, especially in armorless subsea cable applications.

The conductor of this invention is an Aluminium-conductor (Al-conductor) and is made of an alloy comprising from 0.25 to 0.45 wt % iron, from 0.07 to 0.25 wt % copper and from 0.001 to 0.10 wt % boron, and at least 98 wt %, at least 99 wt %, at least 99.2 wt % or at least 99.4 wt % aluminium.

Preferably the conductor is made of an alloy comprising from 0.30 to 0.35 wt % iron, more preferably 0.31-0.32 wt % iron. Preferably the conductor is made of an alloy comprising from 0.15 to 0.20 wt % copper, more preferably 0.16-0.18 wt % copper. Preferably the conductor can be made of an alloy comprising 0.001 to 0.04 wt % boron In exemplary embodiments of the conductor according to the invention the alloy may comprise less than 0.05 wt % zinc, less than 0.2 wt % silicon, less than 0.1 wt % magnesium and other elements that together sum up to less than 0.15 wt %. Preferably the conductor according to the invention may advantageously be made of an alloy also comprising less than 0.05 wt % zinc, less than 0.1 wt % silicon, less than 0.05 wt % magnesium and other elements that together sum up to less than 0.1 wt %. An exemplary Al-conductor according to the invention may advantageously be made of an alloy also comprising 0.0036 wt % silicon, 0.002 wt % magnesium.

Other elements refer to additional elements that may be added to the alloy selected from a group consisting of Mn, Cr, Ni, Bi, Ga, V, Ti, Zn, Si, P, Sn, S, Be, Co, Zr, Pb, Na, Sr, Li, Cd and Mg etc. to improve for example the strength, the thermal stability of the conductor, etc, or undesirable but unavoidable impurities.

An improved grain structure, as shown in FIG. 2 is obtained when the Al-conductor is prepared by a process route involving casting, rolling and drawing. The process route comprises the steps of:

Providing the above described alloy in a molten (liquid) form

Rod casting said alloy yielding a rod. Rod casting entails inline rolling to a desired rod dimension.

The yielding rod may preferably have an ultimate tensile strength (UTS) between 115 and 180 MPa, preferably 138-160 MPa. These conditions shall also at minimum may preferably yield a conductivity of 60.5% IACS, preferably >60.7% IACS.

This rod must then be reduced in cross-section area to a certain range in order to a achieve the desired properties. This depends on the strength of this rod. Such a process is well known to the person skilled in the art. Accordingly, the rod is drawn to a desired final geometry, yielding the conductor eventually followed by stranding to the final conductor design. The conductor will now consist of material with minimum 180 MPa UTS and a minimum conductivity of 59% IACS.

Conductivity measured according to IEC 60468.

Tensile strength & elongation to fracture measured according to ISO 6892-1.

TABLE 1

Properties of rod/drawing stock according to EN 1715-2.

| Material | Rm. (min-max) [MPa] | Conductivity (Min.) [% IACS] |
|---|---|---|
| AW1370 H0 | 60-80 | 61.9 |
| AW1370 H14 | 115-130 | 61.5 |
| AW8030 H24 | 100-150 | 60.2 |
| AW8176 H24 | 100-150 | 60.2 |

TABLE 2

Chemical composition of AW-8xxx series according to EN 1715. 2

| | Si | Fe | Cu | Al (min.) |
|---|---|---|---|---|
| AW8030 | 0.1 | 0.3-0.8 | 0.15-0.30 | 98.55 |
| AW8176 | 0.03-0.15 | 0.4-1.0 | — | |

TABLE 3

| Properties of drawn and heat-treated AW-6101/6201 according to EN 1715, according to EN 50183 | | |
|---|---|---|
| | Rm. (min.) [MPa] | Conductivity (Nom.) [% IACS] |
| AL4 | 315 | 52.9 |
| AL5 | 295 | 55.25 |
| AL7 | 255 | 57.5 |

TABLE 4

| Properties of drawn AW 8030 & 8176 according to EN 1715-2, according to ASTM B800-05 | | |
|---|---|---|
| Temper | Rm. [MPa] | Conductivity (Min.) [% IACS] |
| 0 | 59-110 | 60.6 |
| H1x or H2x | 103-152 | |

The following examples are all based on an Al-conductors comprising from 0.25 to 0.45 wt % iron, from 0.07 to 0.25 wt % copper, from 0.001 to 0.10 wt % boron, less than 0.05 wt % zinc, less than 0.2 wt % silicon, less than 0.1 wt % magnesium, other elements that together sum up to less than 0.1 wt %, and at least 98% aluminium.

A conductor is considered to have a sufficient elongation at break if the elongation at break is >1.8%, preferably >2%, most preferably >3%.

The average elongation ratio is equal to the average longitudinal size (or length) divided by the average transversal size (or width).

Example 1

Rod

Ø9.5 mm/70.9 $mm^2$

UTS [Mpa]=180

The alloy comprises 0.31 wt % Fe, 0.035 wt % Si, 0.18 wt % Cu, 0.002 wt % B, 0.002 wt % Mg, 0.006 wt % Ti and 99.4 wt % Al The rod is reduced to a shaped profile with area of 15.9 $mm^2$ by cold drawing. This corresponds to 78% cross section reduction relative to the original rod. The final wire has the following properties:

UTS: 262 Mpa

Conductivity: 59.2% IACS

Elongation at break: >2.9% (Sufficient for conductors)

The microstructure of the conductor obtained in this example is shown in FIG. 1*a* and measured by the line intercept method:

Average grain size in transversal direction: 1.406 μm (+0.091 μm/−0.081 μm)

Average grain size in longitudinal (drawing) direction: 3.419 μm (+3.48 μm/−1.47 μm)

Average elongation ratio>2

Light optical image of microstructure shows finely dispersed iron particles (black), in the aluminium alloy (white) as shown in FIG. 1*b*.

Example 2

Rod

Ø9.5 mm/70.9 $mm^2$

UTS [Mpa]=180

The alloy comprises 0.31 wt % Fe, 0.035 wt % Si, 0.18 wt % Cu, 0.002 wt % B, 0.002 wt % Mg, 0.006 wt % Ti and 99.4 wt % Al The rod is reduced to a shaped profile with area of 27.1 $mm^2$ by cold drawing. This corresponds to 62% cross section reduction relative to the original rod. The final wire has the following properties:

UTS: 210 Mpa

Conductivity: 59.2% IACS

Elongation at break: >2.2% (Sufficient for conductors)

Example 3

Rod

Ø9.5 mm/70.9 $mm^2$

UTS [Mpa]=150

The alloy comprises 0.32 wt % Fe, 0.036 wt % Si, 0.17 wt % Cu, 0.004 wt % B, 0.002 wt % Mg, 0.006 wt % Ti and 99.4 wt % Al The rod is reduced to a shaped profile with area of 21.0 $mm^2$ by cold drawing. This corresponds to 67% cross section reduction relative to the original rod. The final wire has the following properties:

UTS: 223 Mpa

Conductivity: 59.45% IACS

Elongation at break: >3.4% (Sufficient for conductors)

Example 4

Rod

Ø9.5 mm/70.9 $mm^2$

UTS [Mpa]=150

The alloy comprises 0.32 wt % Fe, 0.036 wt % Si, 0.17 wt % Cu, 0.004 wt % B, 0.002 wt % Mg, 0.006 wt % Ti and 99.4 wt % Al The rod is reduced to a shaped profile with area of 13.4 $mm^2$ by cold drawing. This corresponds to 82% cross section reduction relative to the original rod. The final wire has the following properties:

UTS: 235 Mpa

Conductivity: 59.54% IACS

Elongation at break: >3.1% (Sufficient for conductors)

Said composition yield a finely tuned microstructure (FIGS. 1*a* and 1*b*) which gives the final material a surprisingly beneficial set of properties, especially when using the manufacturing route described above. In addition to the favorable combination of strength and conductivity, the material has superb fatigue and creep properties, discussed later. This is crucial for successful installation of subsea cables at large water depths, relative to the amount of steel armoring. i.e. the prescribed solution is particularly advantageous for armorless subsea cables.

The following table presents the measured tensile strength at rupture in thread (Rm), conductivity and elongation at break of known pre-existing solutions and of the new material (illustrated in examples 1-4):

| Material | Rm. (min-max) [MPa] | Conductivity (Min.) [% IACS] | Elongation at break [%] |
|---|---|---|---|
| AW1370 H0 | 60-80 | 61.9 | >40 |
| AW1370 H14 | 115-130 | 61.5 | >14 |

-continued

| Material | Rm. (min-max) [MPa] | Conductivity (Min.) [% IACS] | Elongation at break [%] |
|---|---|---|---|
| AW8030/AW 8176 H1X or H2X | 103-152 | 60.2-60.6 | >10 |
| AL5 | 295 | 55.25 | >3.5 |
| AL7 | 255 | 57.5 | >3.0 |
| Example 1 | 262 | 59.2 | >2.9 |
| Example 2 | 210 | 59.2 | >2.2 |
| Example 3 | 223 | 59.5 | >3.4 |
| Example 4 | 235 | 59.4 | >3.1 |

These data can be seen in FIG. 2, and show why the current invention (through its examples) is advantageous.

Ultimate tensile strength can be used to make preliminary assessment of the material mechanical strength. For example, typical AW 1350/1370 aluminium is much softer than the other materials and cannot sustain similar mechanical loads. Rm is often used to characterize material strength but does not relate directly to the mechanical limits of a subsea cable conductor. The onset of yielding—i.e. plastic deformation of the material happen prior to the ultimate tensile strength is reached. This is necessary when comparing the higher strength materials such as 8000 and 6000 aluminium series. Subsea cables are also subjected to various prolonged tension or cyclic loading such as under installation or offshore jointing. It is expected that prolonged or cyclic loading will cause cable failure below both the material yield limit and ultimate tensile strength.

It is hence important to characterize the creep and fatigue strength of the materials. In subsea cables, fatigue and creep always co-occur. One way to characterize their combined effect is fatigue testing at elevated mean stress and/or varying test frequency where increased mean stress and/or reduced test frequency increases the amount of creep per cycle. In the following fatigue testing of AW 6201 in T6 condition similar to AL5 conditions is compared with Example 1:

| Testing | Stress | Fatigue life | |
|---|---|---|---|
| mean stress [MPa] | amplitude [MPa] | Example 1 | 6201 T6 Estimated on the basis of the literature (see in the paragraph below) |
| 110 | 90 | 156,413 | 214,545 |
| 110 | 90 | 173,149 | |
| 130 | 67 | 771,688 | 436,476 |
| 130 | 67 | 524,000 | |

It is important to notice that these fatigue tests were done at 1 Hz instead of 10 Hz (as in "Fatigue-Creep in conductors and armoring as constraint for allowable installation depth", 10th international conference on Insulated Power cables, 2019, Johanson et al.). Reducing the frequency gives more time for creep damage. Considering that the fatigue life to failure was still approximately the same or even better signify the improved fatigue-creep life of the example 1 composition and condition. This is particularly impressive when assessing the Rm and conductivity levels. The Rm value for the 6201 alloy was 37% higher while the conductivity was almost 7% lower.

The fatigue-creep properties are best described by fatigue testing at high mean stress relative to the material yield limit as this best investigates the mechanical properties required for having the cable sustain prolonged hang-off from an installation chute at large water depth which is experienced during installation and potential offshore splicing.

This improvement is due to the beneficial effect of iron and copper additions (in the amount specified in the current invention) on the drawing properties leading to the highly beneficial microstructure depictured in FIG. 1.

The conductor possesses other advantageous properties. Compared to a standard conductor, AA1370, the subject of this invention has an allowable strain is improved by 80-100%, stiffness by 100-110% and the maximal tension of the conductor is improved by 400-450%. Increased allowable strain of the conductor and conductor tension can significantly increase allowable installation depth for subsea power cables.

When used in a cable, the conductor increases the maximal cable tension by over 100%. High strength and low weight of the conductor reduces or removes the need for additional axial load carrying elements. This potentially enables armorless designs for installation at more than 1000 m water depth. Low depth challenges cannot be solved by currently available technology.

Furthermore, these conductors can be used to produce subsea cables with less armoring, which can significantly reduce cable costs.

These conductors can also be used in dynamic subsea power cables.

Such conductors allow to reduce cost of subsea cables by introducing a high strength conductor without compromising its conductivity, and the production process remains simple.

The invention claimed is:

1. An aluminium based conductor made of an alloy comprising:

at least 98 wt % aluminium, from 0.25 to 0.45 wt % iron, from 0.07 to 0.25 wt % copper and from 0.001 to 0.10 wt % boron, and wherein the alloy comprises up to 0.50 wt % total of other elements, selected from a group consisting of Mn, Cr, Ni, Bi, Ga, V, Ti, Zn, Si and Mg, each element being present in an amount of less than 0.20 wt %.

2. The conductor according to claim 1, wherein the alloy comprises from 0.30 to 0.35 wt % iron.

3. The conductor according to claim 1, wherein the alloy comprises from 0.15 to 0.20 wt % copper.

4. The conductor according to claim 1, wherein the alloy comprises 0.001 to 0.04 wt % boron.

5. The conductor according to claim 1, wherein the alloy comprises at least 99 wt % aluminium.

6. The conductor according to claim 1, with an average grain size in the longitudinal direction (length) superior to 3 μm and an average grain size in the transversal direction (width) inferior to 2 μm.

7. The conductor according to claim 1, with an average elongation ratio of the grain of more than 1.2.

8. The conductor according to claim 1, wherein the aluminium based conductor is obtained by a process comprising the steps of:

a. providing the alloy in a molten form;

b. rod casting the alloy yielding a rod; and c. drawing the rod to a conductor having a desired final geometry.

9. The conductor according to claim 1, wherein said conductor has an ultimate tensile strength of at least 180 MPa measured according to ISO 6892-1.

10. The conductor according to claim 1, wherein said conductor has a conductivity of more than 59% IACS, measured according to IEC 60468.

11. The conductor according to claim 1, wherein said conductor has an elongation at break of >2.0% measured according to ISO 6892-1.

12. A subsea cable comprising:

the conductor according to claim 1.

13. The subsea cable according to claim 12, where the subsea cable is an armorless subsea cable.

* * * * *